US005438924A

United States Patent [19]

Knoll et al.

[11] Patent Number: 5,438,924

[45] Date of Patent: Aug. 8, 1995

[54] ROTOGRAVURE INKING SYSTEM

[75] Inventors: Wolfgang Knoll; Klaus Mages, both of Lambsheim, Germany

[73] Assignee: Albert-Frankenthal Aktiengesellschaft, Frankenthal, Germany

[21] Appl. No.: 347,242

[22] Filed: Nov. 23, 1994

[30] Foreign Application Priority Data

Nov. 27, 1993 [DE] Germany ..... 43 40 482.0

[51] Int. Cl.[6] ..... B41F 9/06; B41F 31/07

[52] U.S. Cl. ..... 101/153; 101/363

[58] Field of Search ..... 101/349, 350, 351, 352, 101/363, 364, 147, 148, 207, 208, 209, 210, 157, 169, 152, 153, 160, 161, 150; 118/259, 258

[56] References Cited

U.S. PATENT DOCUMENTS 5,103,723 4/1992 Maier ..... 101/153

FOREIGN PATENT DOCUMENTS 1611286 4/1970 Germany .
4030377 8/1993 Germany .
1259097 1/1972 United Kingdom .

*Primary Examiner*—J. Reed Fisher
*Attorney, Agent, or Firm*—Jones, Tullar & Cooper

[57] ABSTRACT

A rotogravure inking system utilizes an inking roller mounted in an ink trough and engageable with a printing cylinder. The inking roller exerts a pressure force on the printing cylinder through the use of torsion bars which are located wholly within the ink trough. A prestress can be applied to the torsion bars to impart the desired pressure force to the printing cylinder from the inking roller.

9 Claims, 1 Drawing Sheet

ROTOGRAVURE INKING SYSTEM

FIELD OF THE INVENTION

The present invention is directed generally to a rotogravure inking system. More particularly, the present invention is directed to a rotogravure inking system having an ink trough, with an inking roller submersed in the ink trough. Most specifically, the present invention is directed to a rotogravure inking system having an inking roller submerged in an ink trough and in pressing contact with a printing cylinder. A constant pressure is applied by the inking roller against the outer surface of the printing cylinder. This constant pressure application is accomplished by supporting the inking roller between outer, free ends of spaced lever arms. The lever arms are connected at their inner ends to torsion bars. These torsion bars can be prestressed to control the pressure applied to the printing cylinder by the inking roller. The torsion bars and lever arms are totally contained within the ink trough.

DESCRIPTION OF THE PRIOR ART

In the field of gravure or rotogravure printing, ink is applied to the surface of a printing cylinder and is then transferred to a web or sheet being printed. The ink is supplied to the printing cylinder from an ink trough into which a portion of the printing cylinder's surface is dipped or immersed. An inking roller is typically supported in the ink trough and contacts the surface of the printing cylinder to insure that the printing ink is properly applied to the printing cylinder.

One prior art inking unit for a gravure printing press is shown in U.S. Pat. No. 5,103,723. In this prior art device there is provided an inking system with an inking roller as well as a mechanism for adjusting the height of the ink trough with respect to the printing cylinder. In this prior device, the inking roller is pressed against the printing cylinder by use of a system of levers and cylinders, such as hydraulic or pneumatic cylinders. The lever arms are supported intermediate their ends by pivot points located within the ink trough. The ends of the lever arms which are connected to the working cylinders extend out beyond the periphery of the ink trough.

While this prior art device is an improvement over the previously existing devices, it requires the use of working cylinders to urge the inking roller against the surface of the printing cylinder. These working cylinders must be located exteriorly of the ink trough and are capable of failing or losing pressure. They are also rather large and since they are situated outside of the ink trough, they require additional space. In addition, they require a supply of hydraulic or pneumatic pressure.

It will thus be seen that a need exists for an inking roller arrangement which overcomes the limitations of the prior art devices. The rotogravure inking system in accordance with the present invention provides such a device and is a significant improvement over the prior art.

SUMMARY OF THE INVENTION

It is an object of the present invention to provide a rotogravure inking system.

Another object of the present invention is to provide a rotogravure inking system having an ink trough with an inking roller submersed in the ink trough.

A further object of the present invention is to provide a rotogravure inking system having a submerged inking roller in contact with a printing cylinder.

Yet another object of the present invention is to provide a rotogravure inking system which allows the contact pressure of the inking roller against the printing cylinder to be pre-set.

Still a further object of the present invention is to provide a rotogravure inking system in which the contact pressure is maintained without the need for pneumatic or hydraulic pressure.

As will be presented in detail in the description of the preferred embodiment which is set forth subsequently, the rotogravure inking system in accordance with the present invention utilizes an ink trough that is provided with an inking roller and into which a printing cylinder dips. The inking roller is biased against the printing cylinder with a pre-set pressure. The inking roller is rotatably supported between spaced first outer or free ends of a pair of lever arms which are located entirely within the ink trough. The lever arms have second inner ends which are joined to outboard ends of sleeves. These sleeves are supported intermediate their ends in pillow block supports. The inboard ends of the sleeves are connected to first or outer ends of torsion bars whose second or inner ends are secured to pillow blocks situated on a bottom plate of the ink trough. The torsion bars can be prestressed, by rotation of the sleeves, to cause the inking roller to impart a desired force against the surface of the printing cylinder.

The lever arms and the torsion bars of the present invention are positioned entirely within the confines of the ink trough. This means that there are no projecting lever arms or their biasing cylinders located exteriorly of the ink trough as is the situation with the prior art devices. This allows the present rotogravure inking system to be installed in substantially less space than required by the prior art devices.

The pressure force of the inking roller against the printing cylinder can be pre-set in accordance with the length of the printing cylinder. If the submersion depth of the printing cylinder or the diameter of the printing cylinder should change the contact force of the inking roller against the printing cylinder can be changed or reset by use of the torsion bars.

The torsion bars and lever arms of the rotogravure inking system are completely contained within the printing ink supplied to the ink trough. This submersion of the torsion bars has no effect on their ability to supply the desired contact force to the printing cylinder. There is no reduction in the functions of the mechanical force applying devices of the present invention even though they are completely enclosed in printing ink.

The rotogravure inking system in accordance with the present invention overcomes the limitations of the prior art devices. It is a substantial advance in the art.

BRIEF DESCRIPTION OF THE DRAWINGS

While the novel features of the rotogravure inking system in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
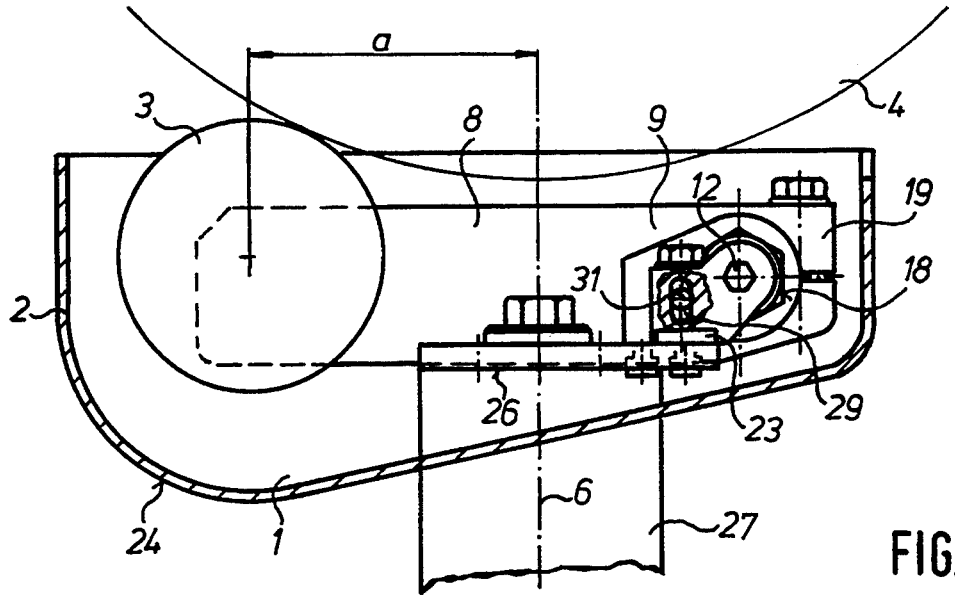
FIG. 1 is a side elevation view, partly in section, of a preferred embodiment of a rotogravure inking system in accordance with the present invention and taken along line I—I of FIG. 2.
Figure 2:
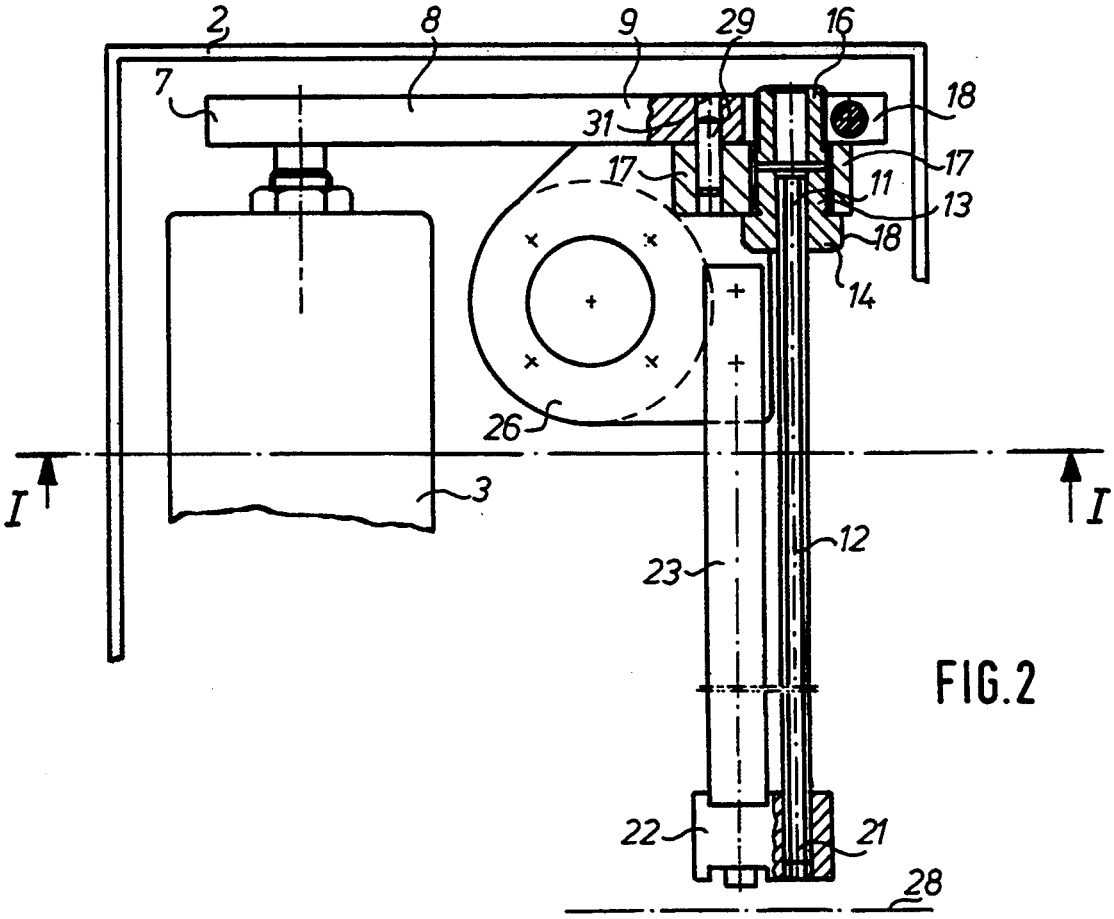
FIG. 2 is a partial top plan view of the rotogravure inking system, with the printing cylinder removed for clarity.

Referring to both FIGS. 1 and 2, there may be seen a preferred embodiment of a rotogravure inking system in accordance with the present invention. It will be understood that this inking system is usable with a gravure or rotogravure printing press of generally known construction and operation. Since the printing press generally forms no part of the present invention, it is not shown in the drawings.

As may be seen most clearly in FIG. 1, an inking roller 3 is located within an ink trough, generally at 2, which is filled to its brim with suitable rotogravure printing ink 1. A printing cylinder 4 is rotatably supported above the ink trough 2 and a portion of the surface of the ink cylinder is immersed in the ink 1 as the printing cylinder 4 is rotated. The printing cylinder 4 is preferably submersed in the printing ink 1 to a depth of typically a few centimeters. This depth of submersion is a preselected value which depends on a number of factors. The inking roller 3 does not have a separate drive assembly but is caused to rotate by frictional contact with the printing cylinder which is driven from the main press drive. The inking roller 3 is typically submersed between 80% to 100% in the ink 1 in the ink trough 2. The inking roller 3 is provided with a textile cover over the roller's jacket surface. This frictional cover is in contact with the surface of the printing cylinder 4. As may be seen in FIG. 1, the printing cylinder 4 is supported for rotation about an axis of rotation which is placed on a perpendicular plane 6. The inking roller 3 is also supported for rotation about its own axis of rotation. The inking roller's axis of rotation is laterally offset from the printing cylinder's axis of rotation by an amount "a". This offset distance is to the left of the vertical plane 6, as shown in FIG. 1.

As may be seen most clearly in FIG. 2, the inking roller 3 is rotatably supported at its ends in first or free ends 7 of lever arms 8 that are located within the confines of the ink trough 2. The lever arms 8 are situated generally adjacent the axial ends of the ink trough 2 and are generally adjacent and parallel to end walls of the ink trough. Each lever arm 8 has a second or inner end 9 which is secured to the ink trough 2 by means of a torsion bar generally at 12. The use of such torsion bars 12, one for each lever arm 8, and the ability of each such torsion bar to be prestressed, allows the inking roller 3 to be biased or forced into contact with the surface of the printing cylinder 4. The amount of force or pressure which the inking roller 3 exerts against the printing cylinder 4 is a function of the prestress applied by the torsion bars 12. It will be understood that only one torsion bar 12 and one end of the inking roller 3 is shown in FIG. 2 and that each end of the inking roller 3 will be similarly supported. The two ends of the inking roller 3 and the support assembly therefore are essentially symmetrical about a horizontal center line 28.

Each torsion bar 12 can be generally hexagonal in cross-section, as seen in FIG. 1. A first or outer end 11 of the torsion bar 12 is inserted into a cooperatively shaped hexagonal bore in an inner or inboard end 14 of a sleeve 13. An external surface 18 of the inner or inboard end 14 of the sleeve 13 has a hexagonal shape so that it will receive an open end wrench which can be used to turn the sleeve 13. The first or outer end 11 of the torsion bar 12 is received in the hexagonal bore in the inboard end of the sleeve 13 in a manner so that it will not rotate or turn relative to the sleeve. The sleeve 13 has a second, outboard end 16 which is provided with external threads or splines. This outboard end 16 of the sleeve 13 is received in a cooperatively threaded or splined bore in the second or inner end 9 of the lever arm 8. The sleeve 13 is supported intermediate its inboard and outboard ends 14 and 16, respectively for rotation in an outboard pillow block bearing 17 which is positively secured to the ink trough 2. By turning the inboard end 14 of the sleeve 13 through application of a wrench to the hexagonal external surface 18 of the sleeve's inboard end 14, the torsion bar 12 can be prestressed. Since the outboard end 16 of the sleeve 13 is received in the threaded bore of the second or inner end 9 of the lever arm 8, this prestress applied to the torsion bar 12 will act through the sleeve 13 to cause the lever arms to elevate the inking roller 3 into contact with the printing cylinder 4. To make sure that the outboard end 16 of the sleeve 13, which has received the first end 11 of the torsion bar 12 in its inboard end 14, is fixed in the threaded or splined bore in the second end 9 of the lever arm 8, this end of the lever arm is provided with a split end clamping piece, as seen at 19 in FIG. 1. Once the outboard end 16 of the sleeve 13 has been situated in the threaded or splined bore in the inner end 9 of the lever arm 8, a clamping bolt is tightened down to close the split end clamp 19 of the inner end 9 of the lever arm to effect an interference or binding clamp force on the end 16 of the sleeve 13 received in the lever arm 8.

An inner or second end 21 of the torsion bar 12 is fixedly clamped in an inboard pillow block 22 which is, in turn, fixedly and securedly connected with the ink trough. This inboard pillow block 22 is provided with a flat strut or cross brace 23. This cross brace 23 extends along the length of the ink trough 2, generally parallel to the torsion bar 12 and is secured to the ink trough adjacent the outboard pillow block 17. This cross brace 23 prevents the torsional prestress imparted to the torsion bar 12 from having an effect on the inboard pillow block 22. Together with the cross brace 23, the pillow block 22 forms an abutment for the reception of the second, inner end 21 of the torsion bar 12.

Referring again to both FIGS. 1 and 2, the ink trough 2 has a bottom plate 24 which is provided with off-center, elevated beads or shoulders 26. These beads or shoulders 26 receive upper ends of generally perpendicularly oriented, downwardly extending supports 27, which may be in the form of toothed racks. These supports 27, which are provided at either end of the ink trough, are usable to move the ink trough 2 in a vertical direction. As may be seen in greater detail in U.S. Pat. No. 5,103,723, these supports or toothed racks 27 are displaceably, but not rotatably supported in guide sleeves, not shown, which are secured to the frame of the printing press. A pinion gear of a drive motor is engaged with each toothed rack. This pinion gear is connected by a drive shaft with a reducing gear with a stepper motor and a counter. The counter is usable to indicate the height of the ink trough 2 and thus can indicate the actual position of the ink trough 2. This height of the ink trough 2 will provide an indication of the immersion depth of the printing cylinder 4 in the rotogravure ink 1 which fills the ink trough 2. The stepper motor can be operated to drive the pinion gear through the reducing gear to either raise or lower the ink trough 2 with respect to the printing cylinder 4. Such raising or lowering of the ink trough 2 may be necessary to accommodate printing cylinders 4 of various diameters.

As was discussed above, a pressure force which the inking roller 3 will impart against the printing cylinder 4 can be preset by adjustment of the two identical torsion bars 12 which are connected to the inner, second ends 9 of the lever arms 8 located at both ends of the inking roller 3. It will be recalled that FIG. 2 depicts only one end of the inking roller 3 and that the assembly is symmetrical about the horizontal center line 28. It will be understood that it would be possible to utilize only one torsion bar 12 instead of the two described herein. The pressure force applied by the ink roller 3 will be preset in accordance with the width of the printing cylinder 4 and with its diameter. Adjustment of the preset force is accomplished by turning the outer ends 11 of the torsion bars 12 with respect to their fixed inner ends 21. This turning is done by turning the inboard ends 14 of the sleeves 13 through application of wrenches to the external hexagonal surfaces 18 of the sleeve inboard ends 14. Since the sleeves 13 are rotatably supported in the outboard pillow blocks 17 and since the threaded or splined outboard ends 16 of the sleeves are clamped in the threaded or splined bores in the inner ends 9 of the lever arms 8, the pre-stress applied to the torsion bars 12 will act through the sleeves 13 to the lever arms 8 and to the inking roller 3.

The outboard pillow blocks 17 each are provided with dowel pins 29 that are placed in bores in the outboard pillow blocks 17 and that extend in the axial direction of the inking roller 3 and the printing cylinder 4 into somewhat elongated, arcuate slots 31 in the lever arms 8. These dowel pins 29 act as stops. In the event that the printing cylinder 4 is moved out of engagement with the inking roller 3, these dowel pins 29 will engage the bottom surfaces of the elongated slots 31 and will thus limit the upward travel of the inking roller 3. When the ink trough 2 is lowered away from the printing cylinder 4, these dowel pins 29 prevent the inking roller 3 from springing upwardly under the influence of the torsion bars 12. The elongated slot 31 into which the dowel pins 29 extend are generally parallel to the vertical plane 6 which passes through the axis of rotation of the printing cylinder 4.

Although not specifically shown in the drawings, it will be understood that the ink trough 2 will have an ink return trough disposed beneath it. This ink return trough will collect excess printing ink 1 that may be removed from the printing cylinder 4. It will also receive any excess printing ink that may overflow the ink trough 2. Any such excess ink will be collected in the ink return trough and can be put back into the ink trough 2.

While a preferred embodiment of a rotogravure inking system in accordance with the present invention has been set forth fully and completely hereinabove, it will be apparent to one of skill in the art that a number of changes in, for example, the size of the printing cylinder, the drive arrangement for the printing cylinder, the type of textile cover applied to the inking roller and the like could be made without departing from the true spirit and scope of the present invention which is accordingly to be limited only by the following claims.

What is claimed is:

1. A rotogravure inking system for a rotogravure printing press, said inking system comprising:

an ink trough provided with a supply of printing ink;

a printing cylinder dipping into said printing ink in said ink trough and having a printing surface;

an inking roller supported in said ink trough and having a jacket surface in contact with said printing surface of said printing cylinder;

first and second spaced lever arms positioned within said ink trough, each of said lever arms having a first end and a second end, said inking roller being rotatably supported between said first ends of said first and second lever arms, said second ends of said lever arms being pivotably secured to said ink trough; and first and second prestressed torsion rods in said ink trough, each of said torsion rods having an outer end connected to said second end of a corresponding one of said lever arms, and an inner end fixedly secured to said ink trough.

2. The rotogravure inking system of claim 1 further including first and second inboard pillow blocks secured to said ink trough with first and second cross braces, and wherein said inner ends of said first and second torsion rods are connected to said first and second inboard pillow blocks.

3. The rotogravure inking system of claim 1 further including first and second outboard pillow blocks secured to said ink trough and wherein said outer ends of said first and second torsion rods are connected to said first and second outboard pillow blocks.

4. The rotogravure inking system of claim 2 further including first and second outboard pillow blocks secured to said ink trough and wherein said outer ends of said first and second torsion rods are connected to said first and second outboard pillow blocks.

5. The rotogravure inking system of claim 1 further including stop means, said stop means limiting pivotal movement of said first and second lever arms in said ink trough.

6. The rotogravure inking system of claim 1 wherein said ink trough is supported for vertical movement by spaced supports.

7. The rotogravure inking system of claim 3 further including first and second sleeves rotatably supported by said first and second outboard pillow blocks, each of said first and second torsion rods being secured to an inboard end of one of said first and second sleeves and said second ends of said first and second lever arms being connected to outboard ends of said first and second sleeves.

8. The rotogravure inking system of claim 7 wherein each of said first and second sleeves has a hexagonally shaped external surface portion.

9. The rotogravure inking system of claim 7 wherein each of said first and second sleeves is supported for movement in said first and second outboard pillow blocks intermediate said inboard and outboard ends.

* * * * *